US005344311A

United States Patent [19]

Black

[11] Patent Number: 5,344,311

[45] Date of Patent: Sep. 6, 1994

[54] AIR ATOMIZING SYSTEM FOR OIL BURNERS

[75] Inventor: Robert K. Black, Monroe, Wis.

[73] Assignee: Universal Foods Corporation, Milwaukee, Wis.

[21] Appl. No.: 990,443

[22] Filed: Dec. 15, 1992

[51] Int. Cl.[5] ..... F23Q 9/00

[52] U.S. Cl. ..... 431/278; 431/12; 431/356

[58] Field of Search ..... 431/18, 2, 4, 12, 253, 431/356, 278; 184/104.2, 104.1; 415/110, 175, 176

[56] References Cited

U.S. PATENT DOCUMENTS

| | | | |
|---|---|---|---|
| 4,519,733 | 5/1985 | Parish et al. | 431/176 |
| 4,659,305 | 4/1987 | Nelson et al. | 431/9 |
| 5,203,680 | 4/1993 | Waldrop | 123/198 DB X |

OTHER PUBLICATIONS

U.S. Ser. No. 07/861,468 filed Apr. 1, 1992 by Hanna et al. and entitled Flue Gas Recirculation System with Fresh Purge for Burners.

ASTM Designation: D396-92 by American Society for Testing and Materials.

M/Series Installation, Operation and Service Manual by Industrial Combustion Division of Aqua-Chem, Inc., IC-993 Sep. 1985.

*Primary Examiner*—Larry Jones

*Attorney, Agent, or Firm*—Whyte Hirschboeck Dudek

[57] ABSTRACT

The capital and operating costs of oil burners comprising rotary air compressors are reduced by using compressors that are lubricated with the fuel oil of the burner. Preferably, the fuel oil has the qualities and flow properties of fuel oil No. 2, and the compressor does not require the peripheral equipment of self-contained lubricating systems, e.g. lube oil storage tank, cooling coils, cooling coils fan, etc.

5 Claims, 3 Drawing Sheets

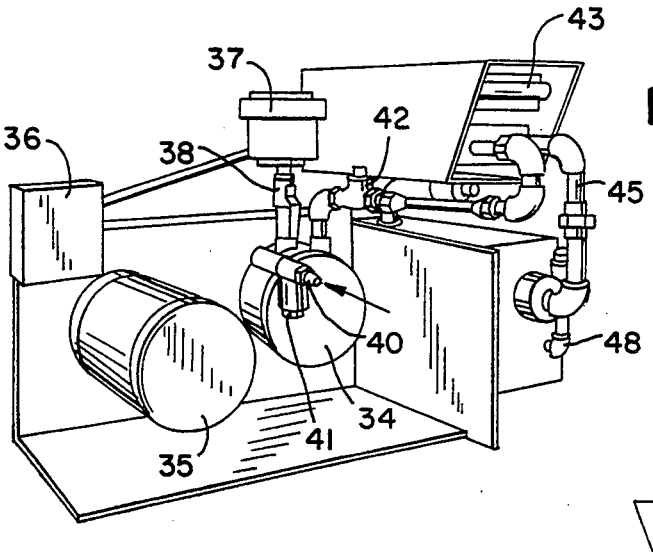
FIG. 2a
PRIOR ART
FIG. 2b
PRIOR ART
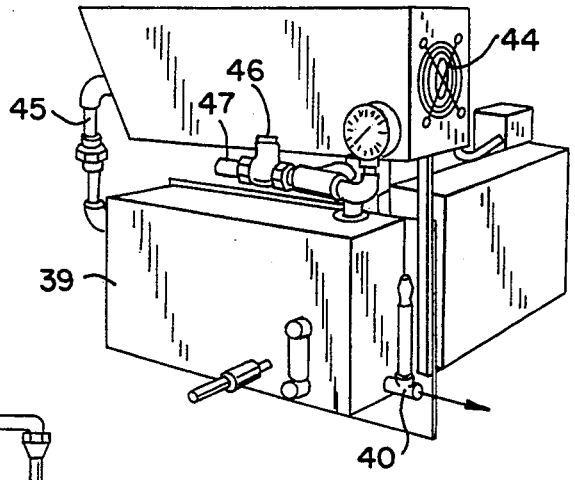
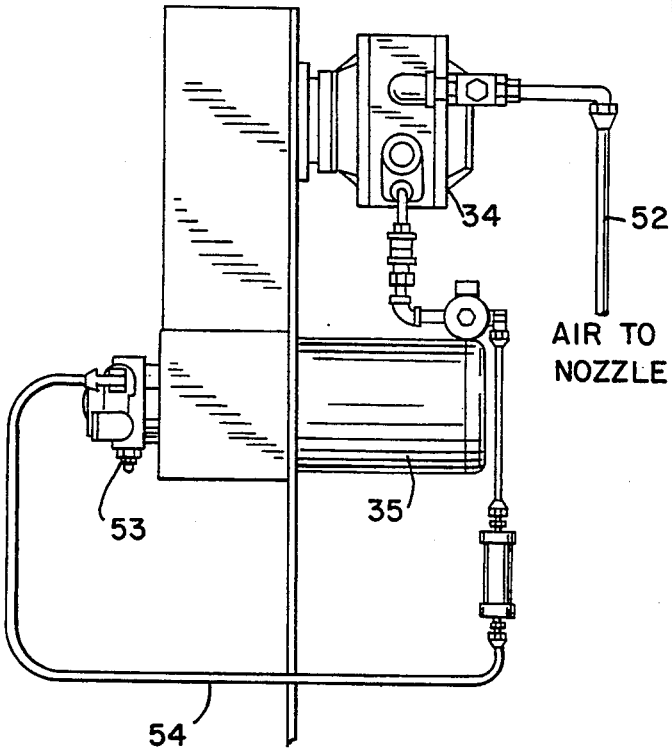
FIG. 4

AIR ATOMIZING SYSTEM FOR OIL BURNERS

BACKGROUND OF THE INVENTION

This invention relates to burners. In one aspect this invention relates to oil burners while in another aspect, this invention relates to oil burners equipped with an air atomization system. In yet another aspect, this invention relates to oil burners in which the air atomization system includes a rotary compressor.

Many burners, i.e. devices designed to produce heat from the combustion of hydrocarbon products or derivatives of hydrocarbon products, are designed to burn oil and of these burners, many are designed to burn more than one grade of oil. Typical of these burners are the scotch or fire box fire tube boilers, cast iron boilers, water tube boilers, air heaters, and dryers. These burners are equipped with various means for delivering the oil from a holding or storage tank to the burner, and for delivering air to the burner for combustion with the oil. The means for delivering the oil from the storage tank (often located a significant distance from the burner) to the burner typically includes a pump and a series of transfer lines, check valves and automatic and manual valves. The means for delivering the combustion air to the burner typically includes an electric motor driven impeller.

Fuel oil does not burn in the liquid state. To be combustible, it must be atomized and intimately mixed with air. Atomization is the process in which a liquid is converted to a spray or to an aerosol with mechanical energy rather than heat. The latter vaporizes the fuel and as such, it is usually used only with low boiling fuels, e.g. gasoline, kerosene, alcohol, fuel oil #1, etc., in gasoline engines and relatively small burners.

Fuel oil of No. 2 grade or heavier can be mechanically atomized by spinning it from the edge of a rapidly rotating cup or disc or by discharging it at high velocity through a nozzle. Pressure atomizing through a nozzle produces a conical spray of fine droplets. These droplets disperse and support themselves solely by kinetic energy (velocity). To burn, these droplets must be mixed with air and heated to their ignition temperature.

Pressure atomized spray droplets rapidly lose velocity after leaving the nozzle due to air friction. Air resistance limits the ability of the droplets to remain in suspension. High atomizing pressure, e.g. pressure in excess of 10 psi, is required to produce fine droplets and aid mixing with secondary air.

Air atomization produces an aerosol in which the fine droplets are supported by an expanding cone of air. An aerosol is a gaseous suspension of fine solid or liquid particles, as opposed to a spray which is a liquid moving in a mass of dispersed droplets. Since the volume of atomizing air is constant regardless of fuel viscosity or oil flow rate, the aerosol cone maintains essentially the same size and shape, regardless of the amount of entrained oil. This permits sizable turn down ratios without change in size or shape of the aerosol cone.

Aerosol droplets moving at the same velocity as the propelling air are not affected by friction. The flame cone retains the same shape at all firing rates. Since the low fire flame is simply shorter, but essentially the same diameter, aerosol mixing with the secondary air is as effective at low fire as at high fire. Conversely, pressure atomized spray, being smaller in diameter at low fire does not mix with the secondary air as effectively and the outer envelope of the secondary air may even completely escape the fuel cone. As such, the turn down ratios with mechanical atomization are much more limited than with air atomization.

Since air supply is an important component of efficient oil burner operation, an integral air compressor is an important component of the oil burner. When properly matched to the characteristics of the burner nozzle, the compressor delivers atomizing air to the burner in an amount sized to the amount and quality of oil which in turn allows the burner to operate at high efficiency.

The compressor is usually one of three types, reciprocating (either single or multiple cylinder), screw or rotary. While reciprocating and screw compressors work well, their cost is often two or three times that of a similar size rotary compressor and as such, rotary compressors are generally favored over reciprocating and screw compressors. However, rotary compressors must be well lubricated to avoid excessive wear and traditionally, these compressors have been equipped with an independent lubricating system. These systems typically comprise a holding tank for the lubricating oil, transfer lines from the tank to the compressor, an oil filter, a separator to remove air from the oil, and a heat exchanger to remove the heat that the oil acquired from the compressor.

Because the lubricating oils enter the compressor by way of a relatively small aperture, e.g. 1/32nd or 1/64th inch in diameter, these oils must be of low viscosity (but liquid) and free of particulate matter. Accordingly, these oils usually pass through a filter and are cooled (by way of the heat exchanger referred to above) before entering the compressor. This system adds to the capital and operational costs of the burner.

SUMMARY OF THE INVENTION

According to this invention, the capital and operational costs of an oil burner comprising a rotary compressor are reduced by lubricating and cooling the compressor with the burner fuel oil. Any fuel oil that can also serve as the lubricating oil for the rotary compressor can be used in the practice of this invention. Typically, the fuel oil has a viscosity less than or equal to that of #2 fuel oil, and it can be drawn from the same tank in which the fuel oil is stored. As such, the oil burner of this invention does not require an independent lubricating system for its rotary compressor.

DESCRIPTION OF THE DRAWINGS

FIG. 2(*a*) is a front view of a prior art rotary air compressor module comprising a rotary compressor with an independent lubricating system.

FIG. 2(*b*) is a rear view of the prior art rotary air compressor module of FIG. 2(*a*).

FIG. 4 is a side view of one embodiment of a rotary air compressor module for an oil burner of this invention.

Like numerals are used to designate like parts throughout the drawings. Various items of equipment, such as valves, fittings, gauges, switches, sensors, etc., have been omitted from the drawings so as to simplify the description of the invention. However, those skilled in the art will realize that such conventional equipment can be employed and placed as desired.

DETAILED DESCRIPTION OF THE PREFERRED EMBODIMENT

Figure 1:
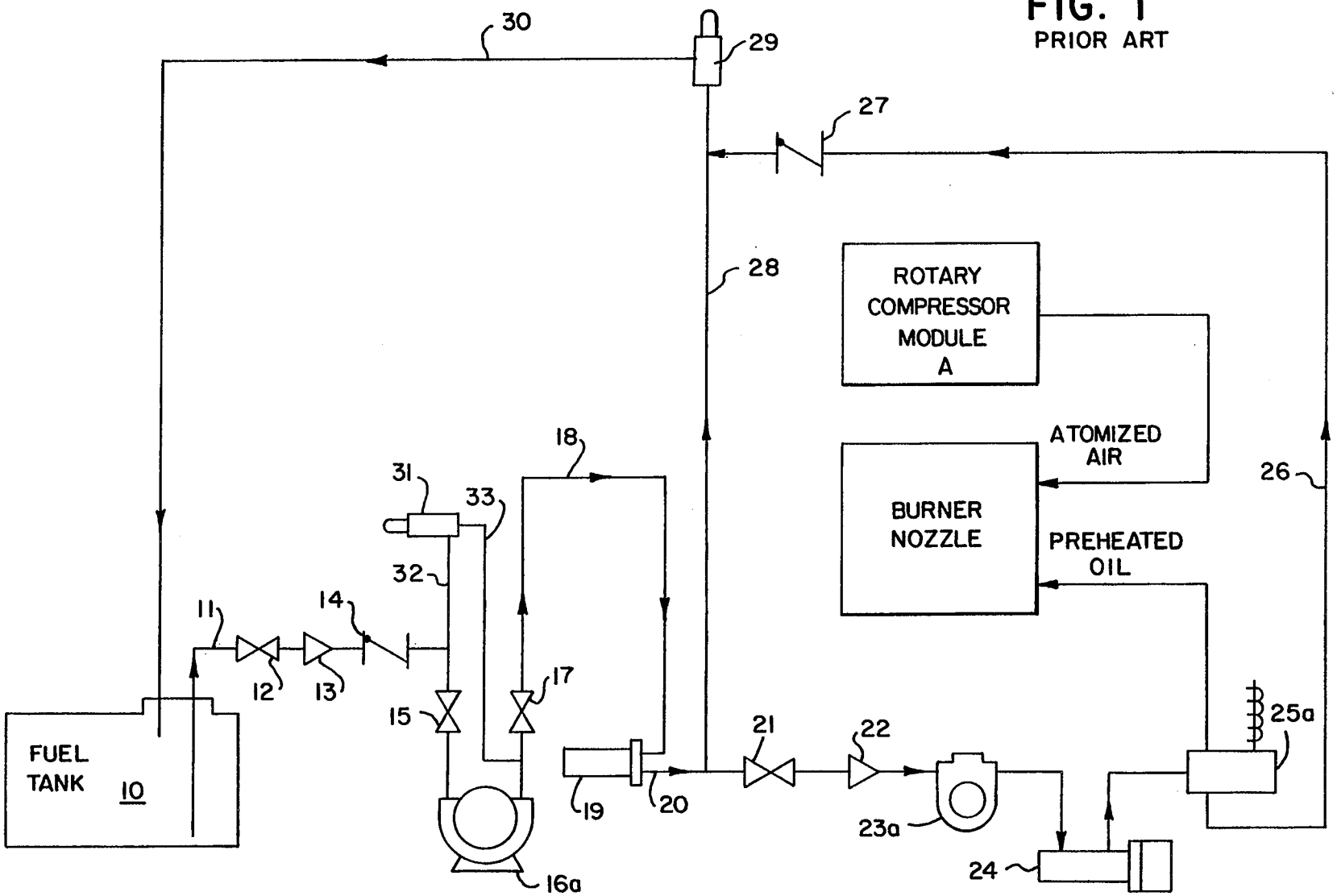
FIG. 1 PRIOR ART
FIG. 1 is a schematic depiction of a typical prior art circulating oil loop for an oil burner.

In FIG. 1, fuel oil is drawn under vacuum from fuel tank 10 by way of pipe 11, through gate valve 12, oil strainer 13, check valve 14, and gate valve 15, by and into oil circulating pump 16*a*. Particulate matter in the fuel oil is removed by oil strainer 13, and check valve 14 keeps oil in the system by preventing oil from back draining into the fuel tank. Oil strainer 13 is sized to remove particles from the fuel oil that could clog the orifice (not shown) through which it enters oil circulating pump 16*a*, e.g. it is sized to remove particles larger than about 1/32".

Oil circulating pump 16*a* passes the oil to the burner by way of gate valve 17 and pipe 18, through heater 19, pipe 20, gate valve 21, oil strainer 22, oil metering unit 23*a*, nozzle line preheater 24, and 3-way solenoid valve 25*a*. Typically, heater 19 warms the oil to a temperature such that it has flow properties equal to or better than the flow properties of a No. 2 fuel oil. Heaters, such as heater 19, are usually employed when the fuel oil is of a number 4, 5 or 6 grade. In those embodiments in which the fuel oil is of No. 2 grade quality (ASTM D396-75) or better, e.g. fuel oil No. 2, low $NO_x$ oil, kerosene, etc., the heater is either not engaged or absent from the loop.

Oil strainer 22 removes particulate matter not removed by oil strainer 13 or which entered the oil at a point in the loop after oil strainer 13. This strainer is sized to remove particulate matter that could clog the oil burner nozzle, e.g. particles larger in size than about 1/16".

The fuel oil is metered by oil metering unit 23*a* (in this embodiment, a positive displacement meter), and then passed to nozzle line preheater 24 for heating prior to delivery to 3-way solenoid valve 25*a*. If it is open, then the fuel oil is routed to the burner nozzle where it is mixed with atomizing air from rotary compressor module A; if it is closed, then it is routed by way of pipe 26 back to fuel tank 10.

Pipe 26 is equipped with check valve 27, and joins pipe 28 in which the fuel oil from 3-way solenoid valve 25*a* mixes with any fuel oil from pipe 20 rerouted by gate valve 21. Pipe 28 is equipped with back pressure valve 29 which in turn is joined to fuel tank 10 by pipe 30. This fuel oil circulation loop is also equipped with relief valve 31 which is connected to pipes 11 and 18 by pipes 32 and 33, respectively. In an embodiment not shown in FIG. 1, relief valve 31 and its associated piping can be replaced by a functionally equivalent device located within pump 16*a*. The back pressure and relief valves provide a release for unwanted pressure in the loop.

FIGS. 2(*a*) and 2(*b*) describe rotary compressor module A of FIG. 1. Air compressor 34 is powered by air compressor motor 35 which is connected electrically to junction box 36. Air enters air compressor 34 by way of air filter 37 and air supply regulating cock 38. Air compressor 34 is lubricated and cooled by a lubricating or lube oil (usually of a viscosity and quality of fuel oil No. 2) drawn from air/lube oil tank 39 by way of pipe 40 (one end of which is shown in FIG. 2*b* and the other end of which is shown in FIG. 2*a*) and lube oil strainer 41. Within air compressor 34, air and lube oil are mixed and compressed to form a lube oil mist. The work of the compressor imparts heat to the mist.

The lube oil mist exits the compressor by way of pipe 42, and it is cooled as it passes through cooling coil 43 through the action of cooling coil fan 44. The mist returns to air/lube oil tank 39 from coiling coil 43 by way of pipe 45. Within air/lube oil tank 39, the mist passes through a metal, typically bronze, wool (not shown) in which a substantial amount of the lube oil is separated from the compressed air. The separated lube oil collects within the tank for ultimate recirculation, while the compressed air leaves the tank for the burner nozzle (not shown) by way of check valve 46 and pipe 47.

Lube oil strainer 41 is sized to remove particles that may clog the nozzles (not shown) through which the lubricating oil enters the air compressor, e.g. particles larger than about 1/32". Make-up lubricating oil can be added to the system through lube oil fill pipe 48.

In the air compressor module of FIGS. 2*a* and 2*b*, the rotary compressor lubricating system is self-contained and the lube oil is consumed only to the extent (other than through degradation) that it is not recovered from the lube oil mist as the mist passes through the metal wool within air/lube tank 39. The unrecovered oil from the lube oil mist is sent with the compressed, i.e. atomizing, air to the burner.

Figure 3:
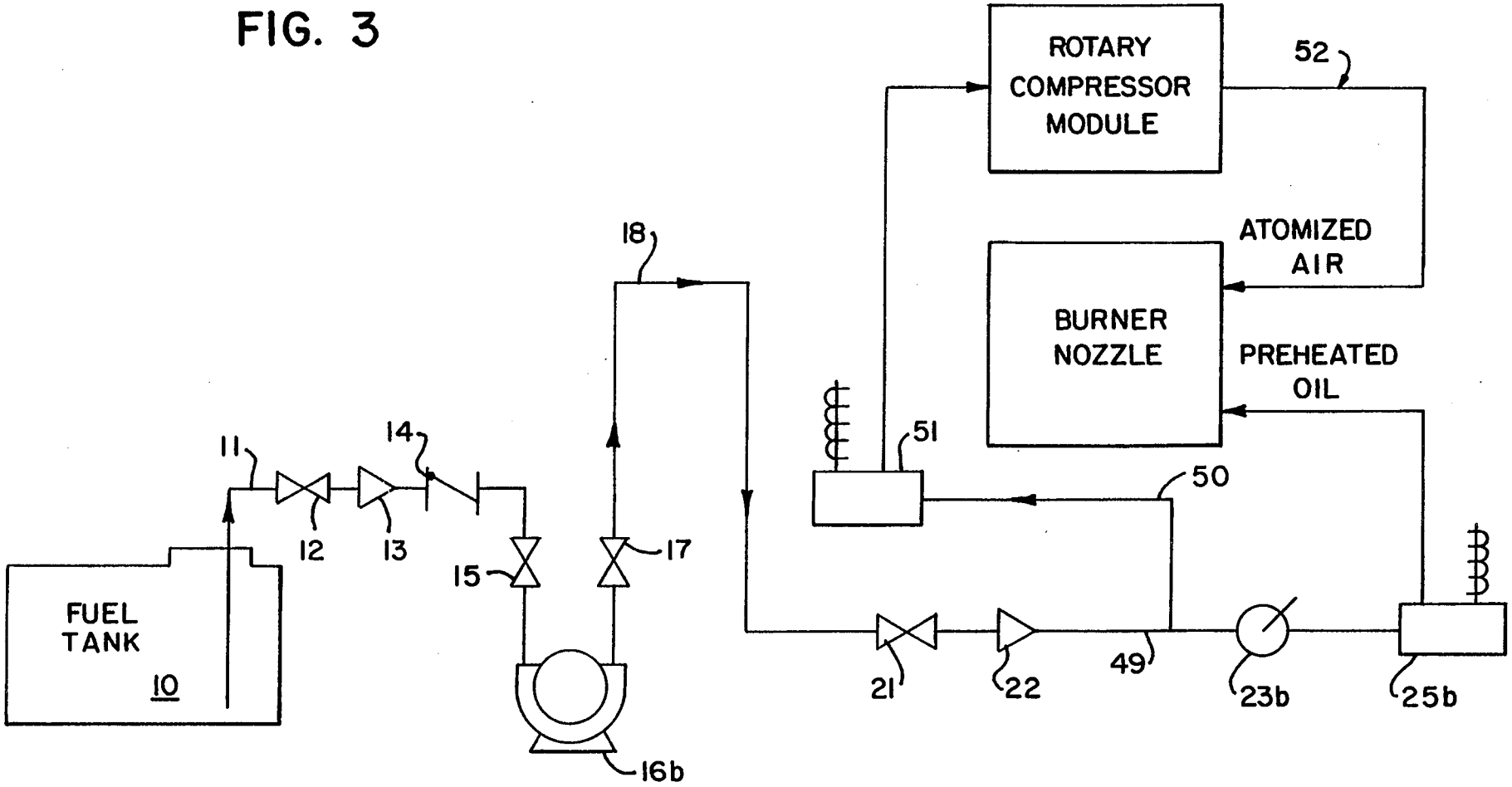
FIG. 3 is a schematic depiction of one embodiment of a circulating oil loop for an oil burner of this invention.

The circulating oil loop of FIG. 3 is one embodiment of this invention, and it is designed for a fuel oil with qualities and flow properties of a No. 2 grade oil or better. From fuel tank 10 through oil strainer 22, this loop is essentially the same as the circulating oil loop of FIG. 1. Relief valve 31 (and its associated piping) is replaced with a functionally similar device (an internal relief valve, not shown) located within oil circulating pump 16*b*, and heater 19 is absent. However, the presence or absence of these particular features, and if present, their placement within the loop, is not critical to the practice of this invention.

The fuel oil leaves oil strainer 22 by way of pipe 49 and is subsequently divided into two streams, the first and larger stream routed to the burner nozzle by way of pipe 49, oil metering unit 23*b*, and 2-way solenoid valve 25*b*. The second and smaller stream is routed to rotary compressor module B by way of pipe 50 and 2-way solenoid valve 51. Atomizing air is delivered to the burner nozzle from module B by way of pipe 52. As such, rotary compressor module B is an integral part of the oil circulating loop.

In the embodiment shown in FIG. 3, oil metering unit 23*b* is an orifice of variable area but other oil metering units, such as the positive displacement oil metering unit of FIG. 1, can also be used. With respect to 2-way solenoid valve 25*b*, if it is open, then the fuel oil is routed to the burner nozzle where it is mixed with atomizing air from the rotary compressor module B; if it is closed, then the fuel oil is not delivered to the burner nozzle and oil circulation within the loop is halted through the action of the back pressure valves of the system. 2-way solenoid valve 51 operates in the same manner. As the fuel oil courses through the loop, it is sufficiently heated through the action of the pumps and meters that heaters such as heaters 19 and 24 of FIG. 1 are unnecessary for the efficient operation of the burner nozzles (although such heaters can be used and placed as desired). Other suitable fuel oils that can be used in this invention include low $NO_x$ oils and kerosene.

FIG. 4 shows one embodiment of rotary compressor module B. Fuel oil is drawn from pipe 49 (FIG. 3) by the action of pump 53 into pipe 54. It then passes through a series of valves, fittings and if desired, heaters and strainers (not shown), and it eventually enters rotary compressor 34. Here the fuel oil is used in the same manner as the lube oil in FIGS. 2(*a*) and 2(*b*) except that it is not recovered. Instead, the fuel oil that becomes entrained in the atomizing air (thus forming the lube oil mist) is simply passed as a part of the atomizing air from rotary air compressor 34 through pipe 52 to the burner nozzle.

By using fuel oil No. 2, or a fuel oil with like qualities and flow properties, as the lube oil for the rotary air compressors, the capital and operating costs of the oil burners of this invention are significantly reduced over those of the prior art. The rotary air compressors of the oil burners of this invention do not require an air/lube oil storage tank, lube oil mist cooling coil and fan, and the piping and attendant equipment necessary to their operation. This also results in lower maintenance costs. Moreover, the overall operation of the oil burner is simplified by the reduction in its total number of component parts.

Although the invention has been described in considerable detail through the preceding specification and drawings, this detail is for the purpose of illustration only. Many variations and modifications, including the addition, substraction and placement of various oil circulation loop and rotary compressor module components, can be made by one skilled in the art without departing from the spirit and scope of the invention as described in the following claims.

What is claimed is:

1. An oil burner adapted for burning fuel oil, the oil burner comprising:

A. a rotary air compressor for producing atomizing air, means for lubricating the compressor with a first stream of the fuel oil;

B. means for transferring the first stream of the fuel oil from a fuel oil source to the rotary air compressor; to form an atomizing air and lube oil mist C. means for transferring the atomizing air from the rotary air and lube oil mist compressor to a burner nozzle for mixture with a second stream of the fuel oil prior to combustion of the resulting mixture of atomizing air, lube oil mist and the second stream of the fuel oil;

D. means for transferring said second stream of the fuel oil from a fuel oil source to the burner nozzle for mixture with the atomizing air, lube oil mist prior to combustion of the resulting mixture; and E. means for igniting the mixture of atomizing air and fuel oil.

2. The burner of claim 1 adapted for burning a fuel oil having the qualities and flow properties of fuel oil No. 2.

3. The burner of claim 2 in which the fuel oil source for the first stream of fuel oil is the same as the fuel oil source for the second stream of fuel oil.

4. The burner of claim 3 in which the means for transferring the second stream of fuel oil from the fuel oil source to the burner nozzle includes a circulating oil pump, at least one relief valve, and at least one oil strainer.

5. The burner of claim 4 in which the means for transferring the first stream of fuel oil from the fuel source to be rotary compressor includes the circulating oil pump, relief valve and oil strainer included in the means for transferring the second stream of fuel oil from the fuel source to the burner nozzle.

* * * * *

UNITED STATES PATENT AND TRADEMARK OFFICE

CERTIFICATE OF CORRECTION

PATENT NO. : 5,344,311

DATED : September 6, 1994

INVENTOR(S) : Robert K. Black

It is certified that error appears in the above-identified patent and that said Letters Patent is hereby corrected as shown below:

On the title page item [73], delete Assignee: Universal Foods Corporation, Milwaukee, Wis. and add -- Assignee: Aqua-Chem, Inc., Milwaukee, Wis. -- .

Signed and Sealed this

Twenty-eighth Day of April, 1998

Bruce Lehman

*Attest:*

BRUCE LEHMAN

*Attesting Officer*

*Commissioner of Patents and Trademarks*